US008910349B1

(12) United States Patent
Holmes, Jr. et al.

(10) Patent No.: US 8,910,349 B1
(45) **Date of Patent: *Dec. 16, 2014**

(54) NET PATCHING DEVICES

(71) Applicant: Foster-Miller, Inc., Waltham, MA (US)

(72) Inventors: Robert G. Holmes, Jr., Worcester, MA (US); Brian A. Coppola, Bedford, MA (US)

(73) Assignee: Foster Miller, Inc., Weltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/061,093

(22) Filed: Oct. 23, 2013

Related U.S. Application Data

(63) Continuation of application No. 13/066,337, filed on Apr. 12, 2011, now Pat. No. 8,615,851, which is a continuation-in-part of application No. 12/807,532, filed on Sep. 8, 2010, now abandoned, which is a continuation-in-part of application No. 12/386,114, filed on Apr. 14, 2009, now Pat. No. 8,011,285.

(60) Provisional application No. 61/124,428, filed on Apr. 16, 2008.

(51) Int. Cl.
*A44B 13/00* (2006.01)

(52) U.S. Cl.
USPC ..... 24/302; 24/300; 24/301

(58) Field of Classification Search
USPC ..... 24/298–302; 89/36.08
See application file for complete search history.

(56) References Cited

U.S. PATENT DOCUMENTS

| | | | | |
|---|---|---|---|---|
| 1,198,035 | A | | 9/1916 | Huntington |
| 1,229,421 | A | | 6/1917 | Downs |
| 1,235,076 | A | | 7/1917 | Stanton |
| 1,385,897 | A | | 7/1921 | Tresidder |
| 2,238,779 | A | | 4/1941 | Mosebach |
| 2,296,980 | A | | 9/1942 | Carmichael |
| 2,308,683 | A | | 1/1943 | Forbes |
| 2,322,624 | A | | 6/1943 | Forbes |
| 2,607,094 | A | * | 8/1952 | Nicosia ..... 403/274 |
| 3,633,936 | A | | 1/1972 | Huber |
| 3,656,790 | A | | 4/1972 | Truesdell |
| 3,875,623 | A | | 4/1975 | Johnson |
| 3,893,368 | A | | 7/1975 | Wales, Jr. |

(Continued)

FOREIGN PATENT DOCUMENTS

| | | |
|---|---|---|
| DE | 691067 | 4/1940 |
| DE | 2206404 | 2/1972 |

(Continued)

OTHER PUBLICATIONS

File history of U.S. Published Patent Application No. 2008/0164379.

(Continued)

*Primary Examiner* — Bret Hayes
*Assistant Examiner* — Joshua Freeman

(57) ABSTRACT

A patching system for a net in a frame with hard points at select nodes of the net includes a patching device with a pair of spaced sockets each configured to receive a hard point therein. A member interconnects the pair of spaced sockets and is configured to properly space the hard points. Another patching device is for reconnecting hard points to the net frame.

36 Claims, 14 Drawing Sheets

(56) References Cited

U.S. PATENT DOCUMENTS

| | | | | |
|---|---|---|---|---|
| 3,992,628 | A | 11/1976 | Karney | |
| 4,051,763 | A | 10/1977 | Thomanek | |
| 4,253,132 | A | 2/1981 | Cover | |
| 4,262,595 | A | 4/1981 | Longerich | |
| 4,358,984 | A | 11/1982 | Winblad | |
| 4,411,462 | A | 10/1983 | Buehrig et al. | |
| 4,738,006 | A | 4/1988 | Juarez | |
| 4,768,417 | A | 9/1988 | Wright | |
| 4,878,274 | A * | 11/1989 | Patricy | 24/306 |
| 4,912,869 | A | 4/1990 | Govett | |
| 4,928,575 | A | 5/1990 | Smirlock et al. | |
| 5,005,266 | A * | 4/1991 | Fister et al. | 24/601.5 |
| 5,007,326 | A | 4/1991 | Gooch et al. | |
| 5,025,707 | A | 6/1991 | Gonzalez | |
| 5,069,109 | A | 12/1991 | Lavan, Jr. | |
| 5,078,117 | A | 1/1992 | Cover | |
| 5,094,170 | A | 3/1992 | Raynaud et al. | |
| 5,170,690 | A | 12/1992 | Smirlock et al. | |
| 5,191,166 | A | 3/1993 | Smirlock et al. | |
| 5,279,199 | A | 1/1994 | August | |
| 5,291,715 | A | 3/1994 | Basile | |
| 5,333,532 | A | 8/1994 | Smirlock et al. | |
| 5,370,035 | A | 12/1994 | Madden, Jr. | |
| 5,394,786 | A | 3/1995 | Gettle et al. | |
| 5,400,688 | A | 3/1995 | Eninger et al. | |
| 5,435,226 | A | 7/1995 | McQuilkin | |
| 5,524,524 | A | 6/1996 | Richards et al. | |
| 5,578,784 | A | 11/1996 | Karr et al. | |
| 5,583,311 | A | 12/1996 | Rieger | |
| 5,622,455 | A | 4/1997 | Anderson et al. | |
| 5,646,613 | A | 7/1997 | Cho | |
| 5,725,265 | A | 3/1998 | Baber | |
| 5,739,458 | A | 4/1998 | Girard | |
| 5,750,918 | A | 5/1998 | Mangolds et al. | |
| 5,792,976 | A | 8/1998 | Genovese | |
| 5,842,939 | A | 12/1998 | Pui et al. | |
| 5,898,125 | A | 4/1999 | Mangolds et al. | |
| 5,924,723 | A | 7/1999 | Brantman et al. | |
| 5,988,036 | A | 11/1999 | Mangolds et al. | |
| 6,029,558 | A | 2/2000 | Stevens et al. | |
| 6,119,574 | A | 9/2000 | Burkey et al. | |
| 6,128,999 | A | 10/2000 | Sepp et al. | |
| 6,279,499 | B1 | 8/2001 | Griffith, Sr. et al. | |
| 6,282,860 | B1 | 9/2001 | Ramirez | |
| 6,311,605 | B1 | 11/2001 | Kellner et al. | |
| 6,325,015 | B1 | 12/2001 | Garcia et al. | |
| 6,345,418 | B1 * | 2/2002 | Bertrand et al. | 24/16 R |
| 6,353,982 | B1 * | 3/2002 | Looker et al. | 24/302 |
| 6,374,565 | B1 | 4/2002 | Warren | |
| 6,375,251 | B1 | 4/2002 | Taghaddos | |
| 6,394,016 | B2 | 5/2002 | Swartout et al. | |
| 6,499,796 | B1 | 12/2002 | Eenhoom | |
| 6,595,102 | B2 | 7/2003 | Stevens et al. | |
| 6,626,077 | B1 | 9/2003 | Gilbert | |
| 6,672,220 | B2 | 1/2004 | Brooks et al. | |
| 6,782,792 | B1 | 8/2004 | Edberg et al. | |
| 6,805,035 | B2 | 10/2004 | Edberg et al. | |
| 6,854,374 | B1 | 2/2005 | Breazeale | |
| 6,901,839 | B2 | 6/2005 | Edberg et al. | |
| 6,904,838 | B1 | 6/2005 | Dindl | |
| 6,925,771 | B2 | 8/2005 | Lee et al. | |
| 6,957,602 | B1 | 10/2005 | Koenig et al. | |
| 7,190,304 | B1 | 3/2007 | Carlson | |
| 7,308,738 | B2 | 12/2007 | Barvosa-Carter et al. | |
| 7,318,258 | B2 | 1/2008 | Chun | |
| 7,328,644 | B2 | 2/2008 | Vickroy | |
| 7,412,916 | B2 | 8/2008 | Lloyd | |
| 7,415,917 | B2 | 8/2008 | Lloyd | |
| 7,513,186 | B2 | 4/2009 | Ravid et al. | |
| 7,866,250 | B2 | 1/2011 | Farinella et al. | |
| 8,132,495 | B2 | 3/2012 | Joynt | |
| 2001/0032577 | A1 | 10/2001 | Swartout et al. | |
| 2002/0134365 | A1 | 9/2002 | Gray | |
| 2003/0217502 | A1 | 11/2003 | Hansen | |
| 2004/0016846 | A1 | 1/2004 | Blackwell-Thompson et al. | |
| 2004/0072634 | A1 * | 4/2004 | Webb | 473/478 |
| 2005/0011396 | A1 | 1/2005 | Burdette et al. | |
| 2005/0016372 | A1 | 1/2005 | Kilvert | |
| 2005/0161657 | A1 | 7/2005 | Dennis | |
| 2005/0278098 | A1 | 12/2005 | Breed | |
| 2006/0065111 | A1 | 3/2006 | Henry | |
| 2006/0112817 | A1 | 6/2006 | Lloyd | |
| 2007/0057495 | A1 | 3/2007 | Tesch et al. | |
| 2007/0089597 | A1 | 4/2007 | Ma | |
| 2007/0180983 | A1 | 8/2007 | Farinella et al. | |
| 2008/0010787 | A1 * | 1/2008 | Kinskey | 24/298 |
| 2008/0164379 | A1 | 7/2008 | Wartmann et al. | |
| 2008/0258063 | A1 | 10/2008 | Rapanotti | |
| 2009/0084284 | A1 | 4/2009 | Martinez et al. | |
| 2009/0104422 | A1 | 4/2009 | Sampson | |
| 2009/0173250 | A1 | 7/2009 | Marscher et al. | |
| 2009/0178597 | A1 | 7/2009 | Sliwa, Jr. | |
| 2009/0217811 | A1 | 9/2009 | Leeming | |
| 2009/0266226 | A1 | 10/2009 | Beach et al. | |
| 2009/0266227 | A1 | 10/2009 | Farinella et al. | |
| 2009/0308238 | A1 | 12/2009 | Schwartz | |
| 2010/0288114 | A1 | 11/2010 | Soukos | |
| 2010/0294124 | A1 | 11/2010 | Wentzel | |
| 2010/0307328 | A1 | 12/2010 | Hoadley et al. | |
| 2011/0079135 | A1 | 4/2011 | Farinella et al. | |
| 2011/0192014 | A1 | 8/2011 | Holmes, Jr. et al. | |
| 2011/0252955 | A1 | 10/2011 | Radstake et al. | |

FOREIGN PATENT DOCUMENTS

| | | | |
|---|---|---|---|
| DE | 2409876 | | 9/1975 |
| DE | 2507351 | | 9/1976 |
| DE | 3834367 | A1 | 10/1988 |
| DE | 3722420 | C2 | 1/1989 |
| DE | 3735426 | A1 | 5/1989 |
| DE | 4437412 | A1 | 10/1994 |
| EP | 0221222 | A1 | 5/1987 |
| EP | 0655603 | A1 | 5/1995 |
| EP | 0872705 | B1 | 10/1998 |
| EP | 0902250 | B1 | 3/1999 |
| FR | 2695467 | A1 | 3/1994 |
| GB | 2449055 | A | 11/2008 |
| WO | WO 99/30966 | | 6/1999 |
| WO | WO 2006/134407 | A1 | 12/2006 |
| WO | WO 2006/135432 | A2 | 12/2006 |
| WO | WO 2008/007001 | A1 | 1/2008 |
| WO | WO 2008/079001 | | 7/2008 |

OTHER PUBLICATIONS

Written Opinion of the International Searching Authority mailed Jan. 18, 2013 for International Application No. PCT/US2012/000196 (seven (7) pages total).

Written Opinion of the International Searching Authority mailed Jan. 31, 2013 for International Application No. PCT/US2012/063207 (six (6) pages total).

Written Opinion of the International Searching Authority mailed Jan. 7, 2010, for International Application No. PCT/US2009/002363 (eight (8) pages total).

* cited by examiner

NET PATCHING DEVICES

RELATED APPLICATIONS

This application is a continuation of U.S. patent application Ser. No. 13/066,337 filed Apr. 12, 2011 which hereby claims the benefit of and priority thereto under 35 U.S.C. §§119, 120, 363, 365, and 37 C.F.R. §1.55 and §1.78, which application is a continuation-in-part of U.S. patent application Ser. No. 12/807,532 filed on Sep. 8, 2010, and which application is a continuation-in-part of U.S. patent application Ser. No. 12/386,114 filed Apr. 14, 2009 now U.S. Pat. No. 8,011,285, which claims the benefit of and priority to U.S. Provisional Patent Application Ser. No. 61/124,428 filed Apr. 16, 2008.

FIELD OF THE INVENTION

The subject invention relates to ordinance shielding.

BACKGROUND OF THE INVENTION

Rocket propelled grenades (RPGs) and other ordinance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6,957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain like fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s, RPG-69s, and RPG-7Ls have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Chain link fencing has been used in an attempt to dud RPGs by destroying the RPG nose cone. See, for example, DE 691,067. See also published U.S. Patent Application No. 2008/0164379. Others have proposed using netting to strangulate the RPG nose cone. See published U.S. Application No. 2009/0217811 and WO 2006/135432.

WO 2006/134407, insofar as it can be understood, discloses a protective grid with tooth shaped members. U.S. Pat. No. 6,311,605 discloses disruptive bodies secured to armor. The disruptive bodies are designed to penetrate into an interior region of a shaped charge to disrupt the formation of the jet. The shaped charge disclosed has a fuse/detonator mechanism in its tail end.

Co-pending patent application Ser. No. 12/807,532 discloses a more effective vehicle and structure shield including a plurality of spaced hard points held in position via the nodes of a net and used to dud an RPG or other threat.

In use in the field, however, it is possible that the net cords or strands between two hard points or between a hard point and the net frame may break. When this happens, one or more hard points may no longer be correctly spaced resulting in less effective and more vulnerable areas of the shield. A breakage of a cord or strand may also cause other cords or strands to break.

BRIEF SUMMARY OF THE INVENTION

The invention, in one example, provides a patching device for a hard point style net shield which is easy and intuitive to use, which quickly patches broken net cords, and which correctly spaces the hard points.

The subject invention, however, in other embodiments, need not achieve all these objectives and the claims hereof should not be limited to structures or methods capable of achieving these objectives.

This invention features a patching system for a net with hard points at select nodes of the net. One preferred patching device includes a pair of spaced sockets each configured to receive a hard point therein and a member interconnecting the pair of spaced sockets configured to properly space the hard points.

Each socket preferably includes a retention mechanism for locking a hard point therein. Each socket may include a peripheral side wall with slots therein for cords of the net. Typically there are two pairs of opposing slots and the retention mechanism then typically includes an inwardly extending lip at a proximal end of the side wall between the slots. The member can be a plastic body or a net cord. Each socket is typically round and made of plastic. There can be a third socket connected to one of the pairs of sockets by another member.

Each socket may include one or more alignment features for aligning a hard point in the socket and/or one or more tensile alignment features aligning tensile loads with the interconnecting member. Each socket may include flexible fingers which accept a hard point when flexed outward and then spring back capturing the hard point. Each finger may include an inward retention lip.

In one version, a patching device comprises a first socket including a peripheral side wall with slots therein for cords of the net and an inward lip at a proximal end of the side wall between the slots for retaining a first hard point in the first socket. A second socket includes a peripheral side wall with slots therein for cords of the net. A proximal end of the side wall between the slots includes an inward lip for retaining a second hard point in the second socket. A member interconnects the first and second sockets.

A patching device for a net with hard points at select nodes of the net, the patching device comprising: a first socket including a peripheral side wall with slots therein for cords of the net and an inward lip at a proximal end of the side wall between the slots for retaining a first hard point in the first socket; a second socket including a peripheral side wall with slots therein for cords of the net and an inward lip at a proximal end of the side wall between the slots for retaining a second hard point in the second socket; and a member interconnecting the first and second sockets. The inward lip of each socket may include hard point alignment features.

One preferred patching device comprises a first socket including flexible fingers which accept a first hard point therebetween when flexed outward and then spring back capturing the first hard point in the first socket; a second socket including flexible fingers which accept a second hard point when flexed outward and then spring back capturing the second hard point in the second socket, and a member interconnecting and spacing the sockets and the first and second hard points apart from each other. Each finger of each socket typically includes a retaining lip.

This invention also features a method of patching a net having hard points at select nodes of the net and a broken net cord between first and second hard points. One preferred method includes placing the first hard point in a first socket and placing the second hard point in a second socket spaced from the first socket by a member configured to properly space the hard points.

In another patch device, a first member is securable to a frame member, a second member is configured to lock on to a hard point, and there is a linkage between the first member and the second member patching a broken net cord between a frame member and a hard point. Preferably, the first member is flexible such as a fabric piece including Velcro thereon. In one embodiment, the second member includes a loop of string directed under a first net cord, over a second net cord, under a third net cord, and then the first member is threaded through the loop. In another embodiment, the second member includes a socket configured to receive a hard point therein.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
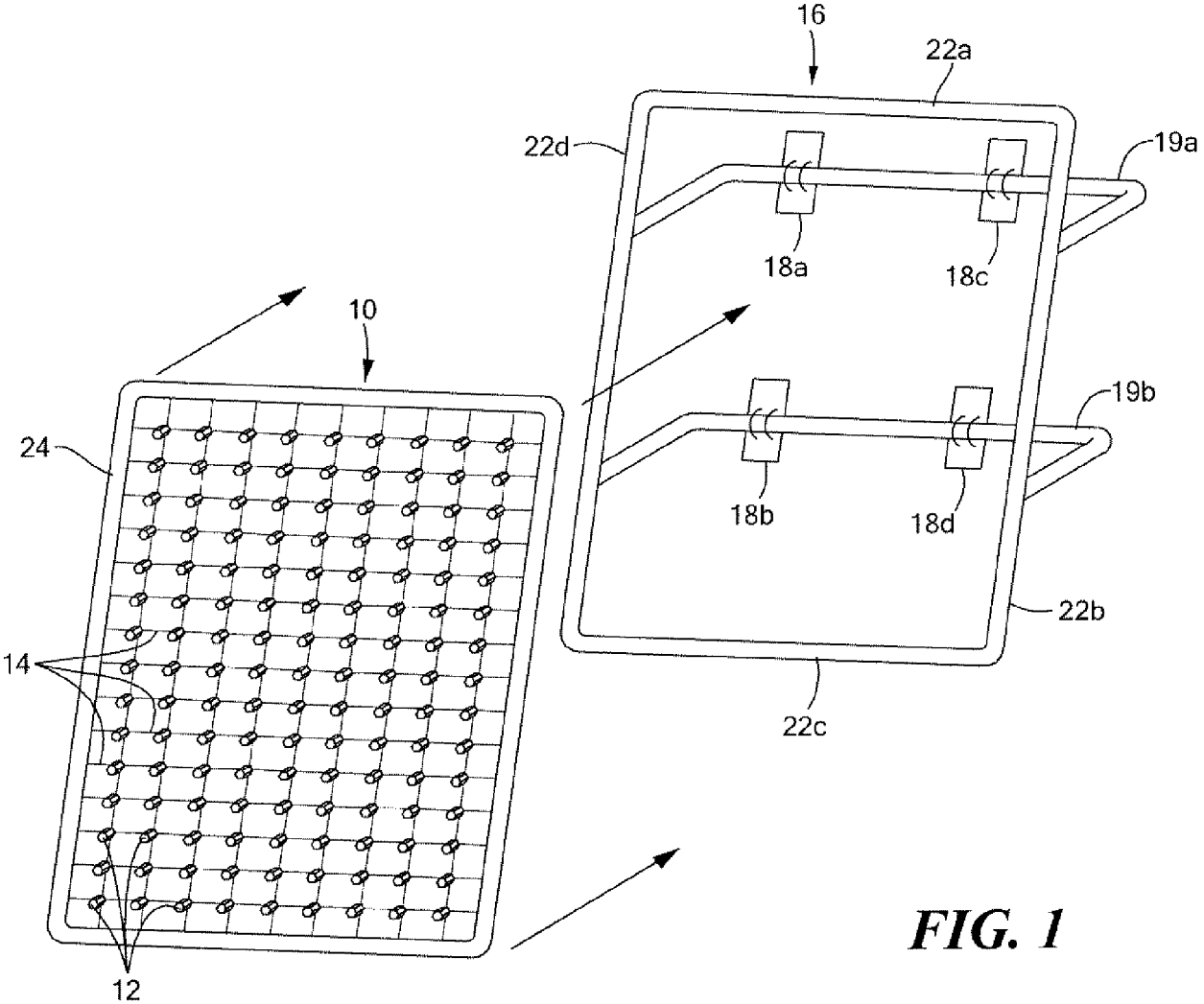
FIG. 1 is a schematic three-dimensional exploded view showing an example of one shield protection system in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of net subsystem 10 including an array of hard points 12 configured to impact a projectile (e.g., the nose cone of an RPG striking net 14). Frame 16 includes mounting brackets 18*a*-18*b* attached to rearwardly extending members 19*a* and 19*b*. The function of frame 16 and nets 14 is to position hard points 12 in a spaced relationship with respect to a vehicle or structure and to space the hard points 12 away from each other in an array. When an RPG impacts net 14, hard points 12 may angle inwardly towards the nose of an RPG tearing into it and duding the electrical and/or electronic signals associated with the arming or detonation mechanisms of the RPG. Preferably, net subsystem 10 is removeably secured to frame 16 and frame 16 is removeably secured to vehicle 20. In one particular example, frame members 22*a*-22*d* include hook-type fasteners secured to the outside thereof and the net periphery 24 includes loop-type fasteners on the inside thereof.

Figure 2:
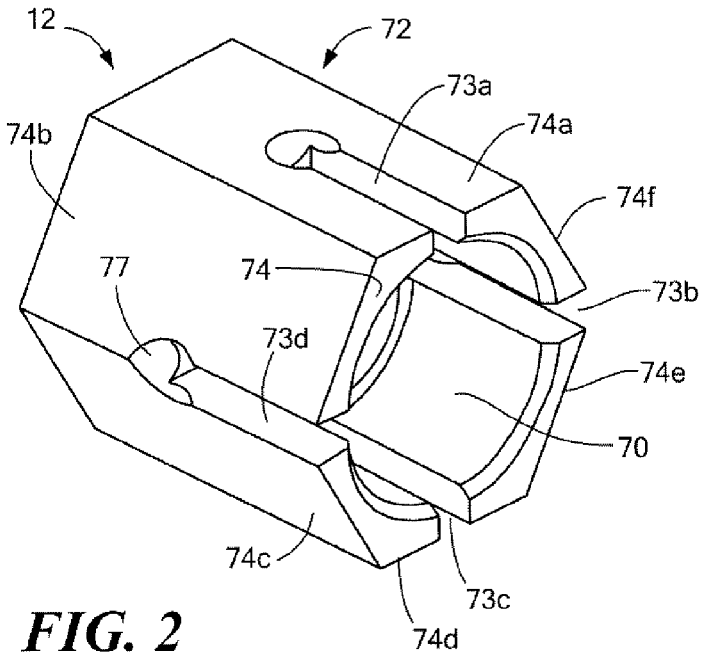
FIGS. 2-3 are schematic views of one example of a hard point in accordance with examples of the invention.
Figure 3:
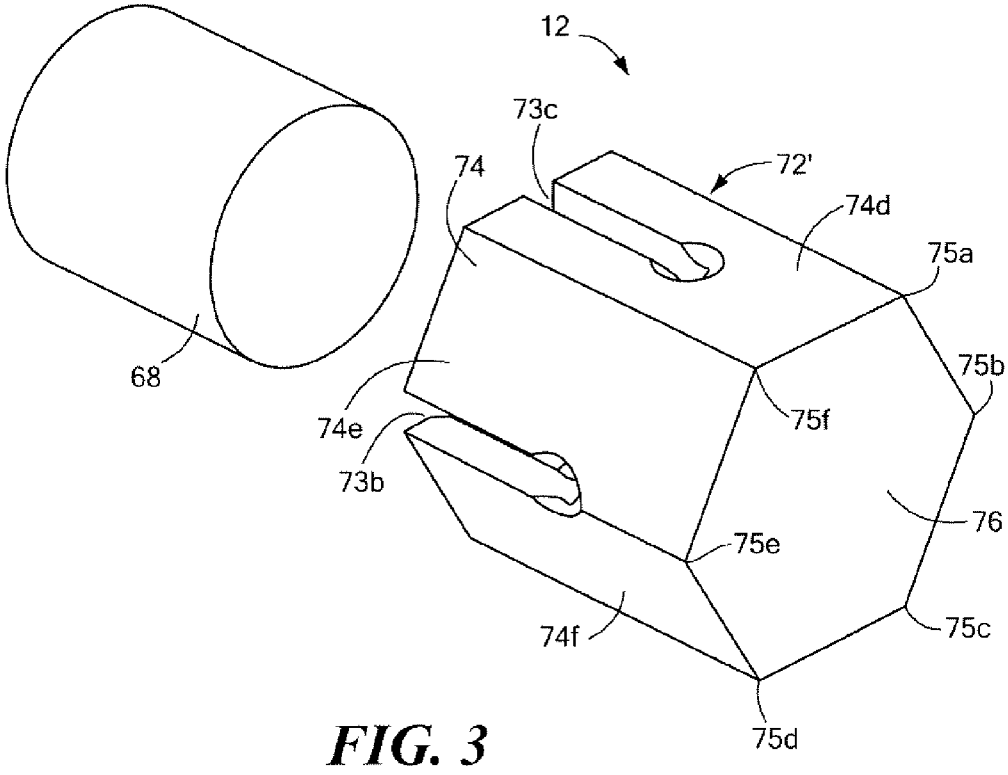

FIGS. 2-3 show an example of hard point 12 with base portion 72 with cavity 70 receiving post or plug 68 therein in a friction fit manner. In this preferred design, the net cords are received through slot 73*a*-*c* and wall 74 of hard point 12.

Slots 73*a* and 73*c* receive vertically extending cords while slots 73*d* and 73*b* receive horizontally extending cords. In one specific design, the hard point and the plug were made of steel, hard point 72 was 0.625 inches from one edge to an opposite edge, and 0.72 inches tall. Cavity 70 was 0.499 inches in diameter and 0.34 inches deep. Five gram cylindrical plug 68, FIGS. 7A-7B was 0.35 inches tall, 0.500 inches in diameter, and includes knurling as shown at 78 on the outer wall surface thereof.

Side walls 74*a*-74*f* extend rearward from front face 76 defining cavity 70 surrounded by the side walls. Opposing sidewalls 74*a* and 74*d* have slots (73*a*, 73*c*) in the middle of each side wall. Slots 73*d*, and 73*b*, in turn, are between adjacent sidewalls 74*b* and 74*c* and 74*f* and 74*e*, respectively. Sidewall 74*b* and 74*c* are between opposing sidewalls 74*a* and 74*b* on one side of member 72 while sidewall 74*f* and 74*e* are between opposing sidewalls 74*a* and 74*d* on the opposite side of member 72'.

Figure 6:
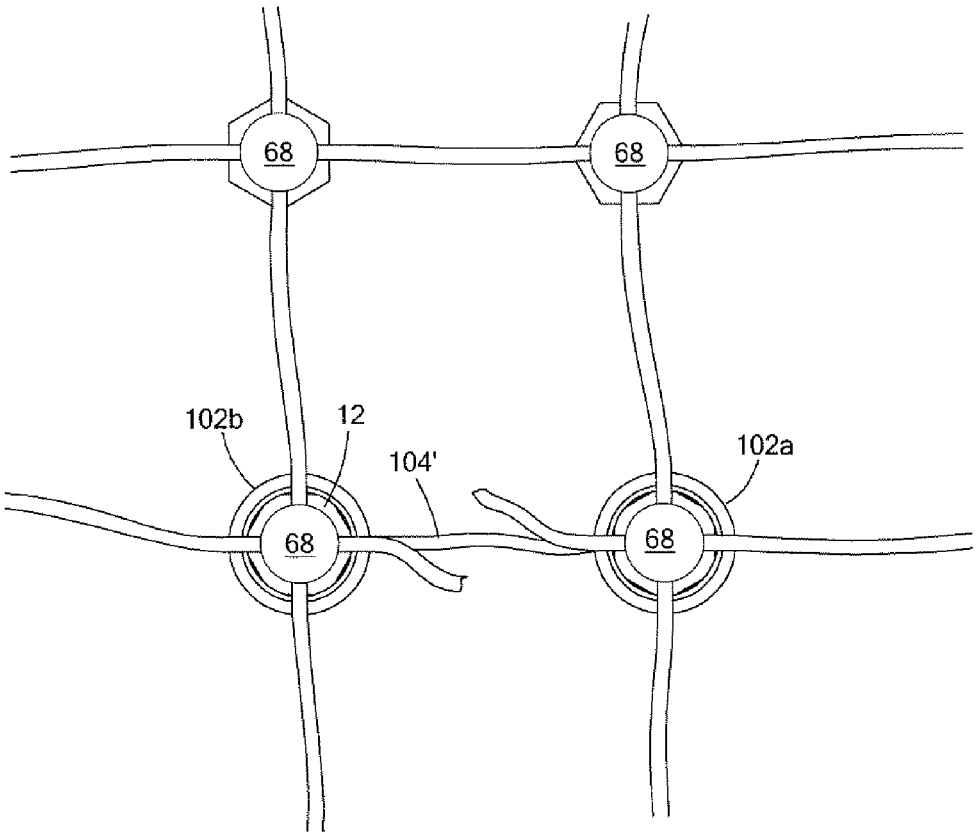
FIG. 6 is a schematic three-dimensional front view showing another example of a patch device in accordance with the invention.

In this specific design, the base portion 72 and plug 68 (FIG. 7) were made of hardened steel (e.g., ASTM A108 alloy 12L14) and combined weighed between 10 and 80 grams. A base portion with more or less sides is also possible. For a six sided design, the area of face 76, FIG. 6B, is typically about 0.5 in.$^2$, e.g. between 0.1 and 0.8 in.$^2$. Sidewalls 74*a*-*f* typically have an area of 0.37 in.$^2$, e.g., between 0.1 and 0.8 in.$^2$. Slots 73*a*-*d* may be 0.05-0.15 inches wide and between 0.2 and 0.8 inches long.

Manufacturing of a net with hard points in accordance with the subject invention is thus simplified. A net node is placed in cavity 70 with the net cords exiting through slots 73*a*-73*d* and plug 68 is then driven in to cavity 70 to lock the node of the net in the hard point. The hard points are typically made of conductive material and may include a protective rust resistant non-reflective, conductive coating (zinc plating, flat olive in color). In one example, base portion 72 weighed 30 grams and was machined from 0.625 hex bar stock. Walls 74*a*-74*f* were 0.72" tall. Slots 73*a*-73*d* were 0.080 inches across and 0.350" in length. These dimensions will vary, however, depending on the design of the net.

There are trade offs in the design of the hard points and also the net. The aspect ratio of the hard points, their size, center of gravity, mass, and the like all play an important role. Hard points which are too large, for example, and a net mesh size which is too small, results in too much surface area to be stricken by an RPG, possibly detonating the RPG. Hard points which are too small may not sufficiently damage the RPG ogive and dud the RPG. Steel is a good material choice for the hard points because steel is less expensive. Tungsten, on the other hand, may be used because it is heavier and denser, but tungsten is more expensive. Other materials are possible. The hard points may be 0.5 inch to 0.75 inches across and between 0.5 inches and 1 inch tall.

It is preferred that the net node is placed at the center of gravity at the hard point. The length of the hard point is preferably chosen so that when an RPG strikes the net, the hard point tumbles 90 degrees and digs into the RPG ogive. The moment of inertia of the hard point is designed accordingly. In still other designs, the hard point may haw more or less than six sides. The hard points may weigh between 10 to 80 grams although in testing 60 grams was found to be optimal, e.g., a 30 gram base portion and a 30 gram plug. Hard points between 10 and 40 grams are typical.

The net material may be polyester which provides resistance to stretching, ultraviolet radiation resistance, and durability in the field. Kevlar or other engineered materials can be used. A knotted, knotless, braided, or ultracross net may be used. The cord diameter may be 1.7 to 1.9 mm. Larger net cords or multiple cords are possible, however, the cord(s) design should be constrained to beneath threshold force to dynamic break loads typical of RPG impact and engagements. The typical net mesh size may be 176 mm (e.g., a square opening 88 mm by 88 mm) for a PG-7V RPG and 122 mm for a PG-7 VM model RPG. But, depending on the design, the net mesh size may range from between 110 and 190 mm.

The preferred spacing or standoff from the net to the vehicle is between 4 and 24 inches, (e.g., 6-12 inches) but may be between 4 and 60 centimeters. Larger standoffs may extend the footprint of the vehicle and thus be undesirable. Too close a spacing may not insure closing of the electrical circuitry of the RPG ogive by the hard points. The frame and mounting brackets are designed to result in the desired spacing.

It is desirable that the net material and mesh size be chosen and the net designed such that an RPG ogive, upon striking a net cord, does not detonate. RPGs are designed to detonate at a certain impact force. Preferably, the breaking strength of the net cord material is around 240 lbs so that an RPG, upon striking a net cord or cords, does not detonate. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The overall result of the subject invention is a design with more available surface area where duding occurs as opposed to detonation.

Figure 4:
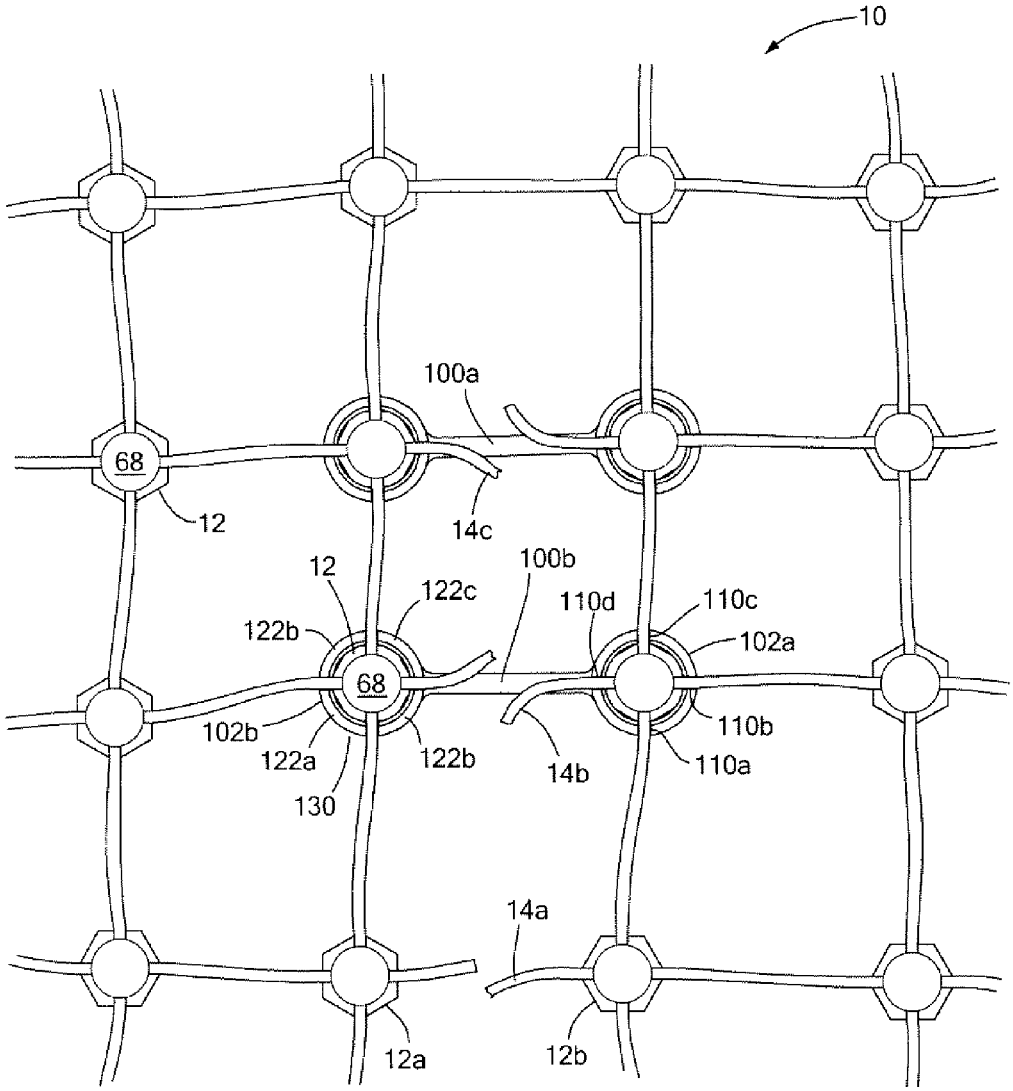
FIG. 4 is a schematic rear view showing a section of a hard point net with broken net cords and two patches shown in place between adjacent hard points in accordance with an example of the invention.

FIG. 4 shows a portion of hard point net 10 with broken net cords 14*a*, 14*b*, and 14*c*. As discussed in the background section above, hard points 12*a* and 12*b* may no longer be properly spaced and thus can be less effective. The breakage of net cord 14*a* can also cause other net cords to weaken and/or break in field use.

Figure 5:
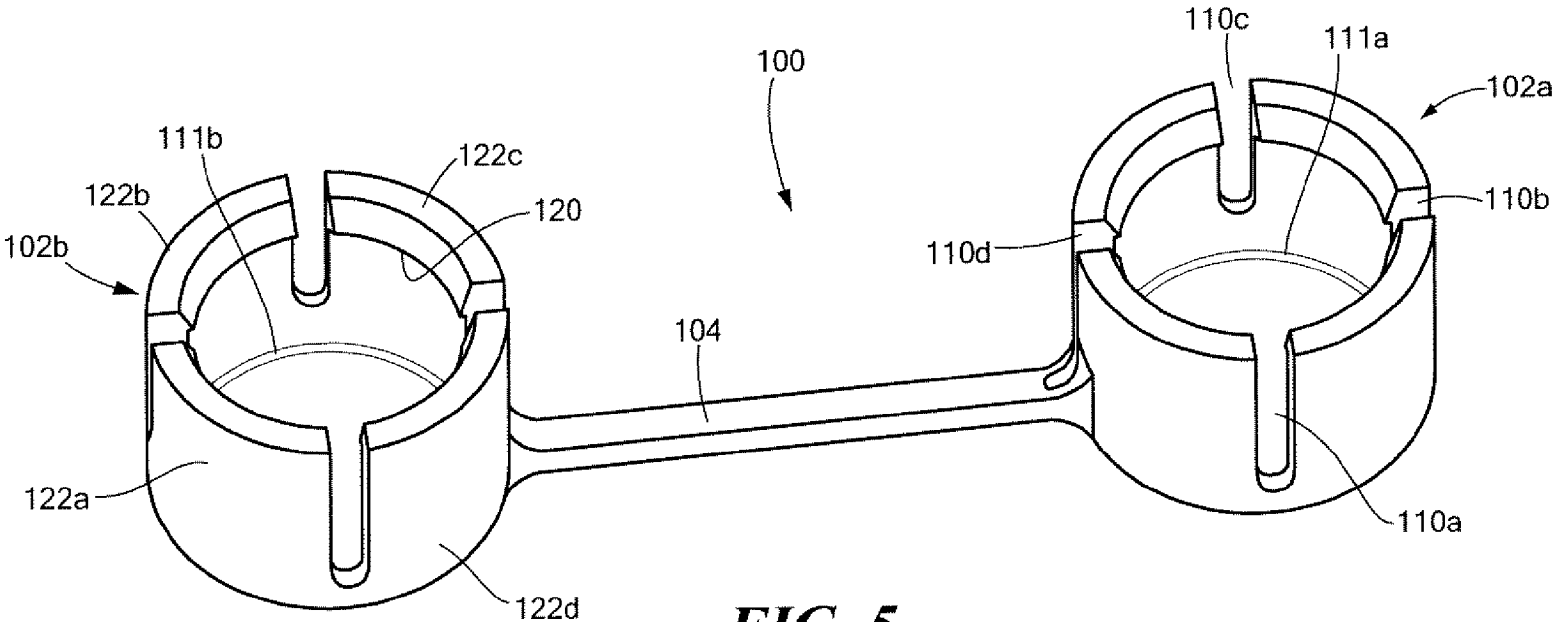
FIG. 5 is a schematic three-dimensional top view of one of the patch devices shown in FIG. 4.

FIG. 4 also shows patch devices 100*a* and 100*b*. A similar patch device would typically be provided to repair broken net cord 14*a* in the field. As shown in FIG. 5, patch device 100 includes spaced sockets 102*a* and 102*b* configured to receive spaced hard points (12, FIG. 4) therein. Member 104 connects the pair of sockets 102*a* and 102*b* and is configured to (e.g. has a length which) properly spaces the hard points as they were intended to be spaced before the cord between them broke. In one example, member 104 was about 1⅜" long and the outer diameter of sockets 102*a* and 102*b* was about 15/16" while the inner diameter of the sockets was about 11/16".

In this particular design, each spaced socket includes, as shown for socket 102*a*, a peripheral side wall 108 with slots 110*a*-110*d* therein for the cords of the net. Opposing slots 110*d* and 110*b* are oriented to line up with member 104 which replaces the broken cord and opposing slots 110*c* and 110*a* line up with the cords at 90° to member 104.

The hard points are preferably retained in sockets 102*a* and 102*b* via a retention mechanism which, in this particular example, as shown for socket 102*b* includes inwardly extending lip 120 at the top of side wall 108 between the slots. The slots thus form fingers 122*a*-122*d* each with an internal grasping lip. When a hard point as shown at 130 in FIG. 4 is inserted into the cavity of the socket, fingers 122*a* and 122*d* spread apart slightly and then spring back whereupon the top inward lip 120, FIG. 5 retains the hard point in the socket from movement back out of the socket. The net cord is now at the distal end of the socket wall slots retaining the hard point from further moving through the socket. Other means for retaining the hard point within a socket are within the scope of the invention. Ridges 111*a* and 111*b* at the bottom inside of each socket serve to align any tensile loads with the long axis of connecting member 104. That is, when two hard points are forced away from each other, the slots 110 of one or both sockets 102 may tend to spread allowing a hard point to escape its socket. This ridge 111 or another tensile load alignment feature ensures contact between the socket and the hard point, aligns the tensile load with the connecting member, and prevents slots 110 from spreading apart to better retain each hard point in its respective socket. Ridge 111 is typically only 0.010" tall.

Figure 9A:
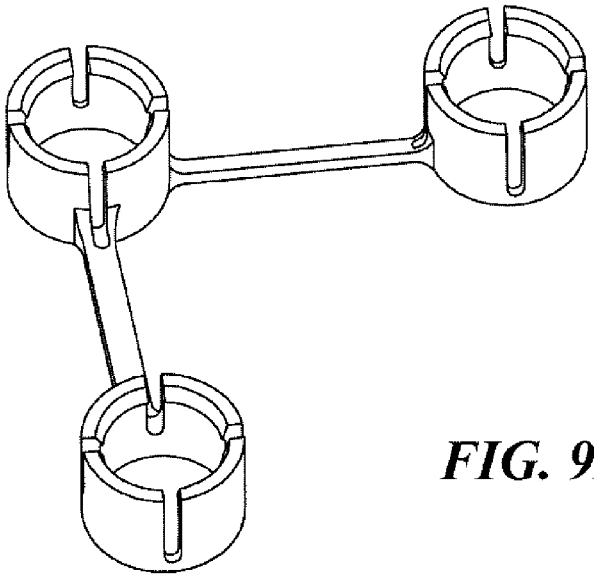
FIGS. 9A-9B are schematic three-dimensional views show further examples of patch devices in accordance with the invention.
Figure 9B:
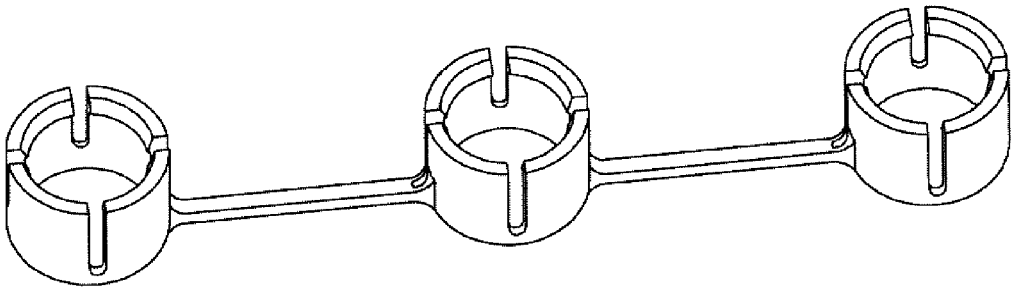

The cavities of the sockets are typically round as shown in FIG. 5 due to the different hard point orientations which might be possible in a given net. Other socket designs, however, are possible. In the embodiment shown so far, each patch is made of plastic and connecting member 104 is a solid body. But, in other embodiments, member 104 could be a flexible strand, net cord, or strap as shown at 104' in FIG. 6. In FIG. 9, the patches include more than two sockets as shown.

Figure 7A:
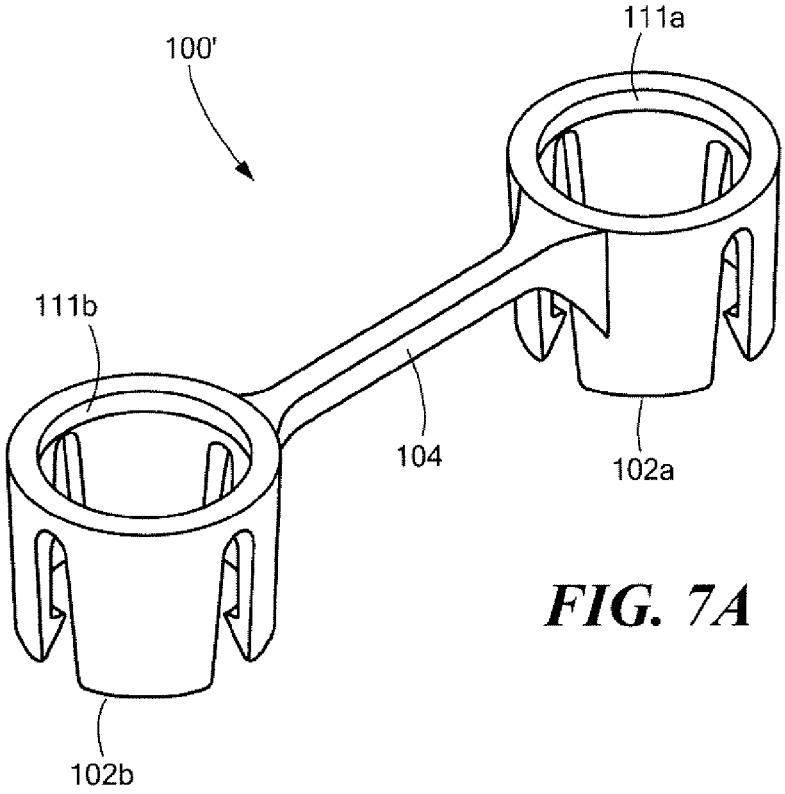
FIGS. 7A-7B are views of another patch device in accordance with examples of the invention.
Figure 7B:
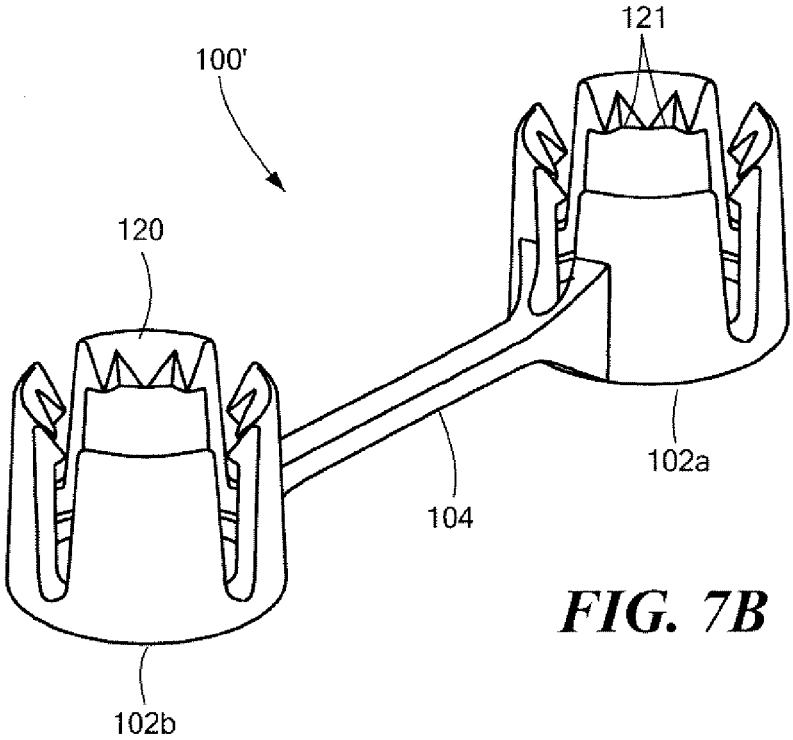
Figure 8A:
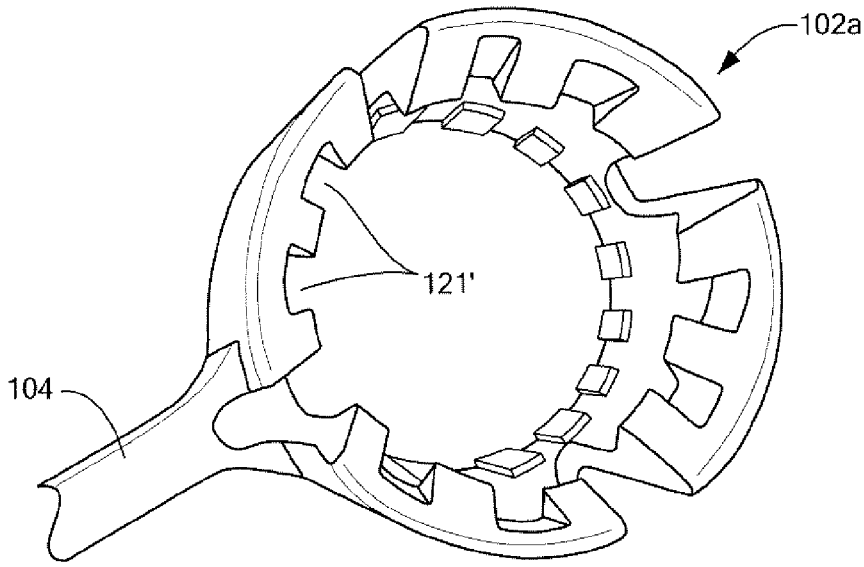
FIGS. 8A-8B are partial views of another patch device of the invention.
Figure 8B:
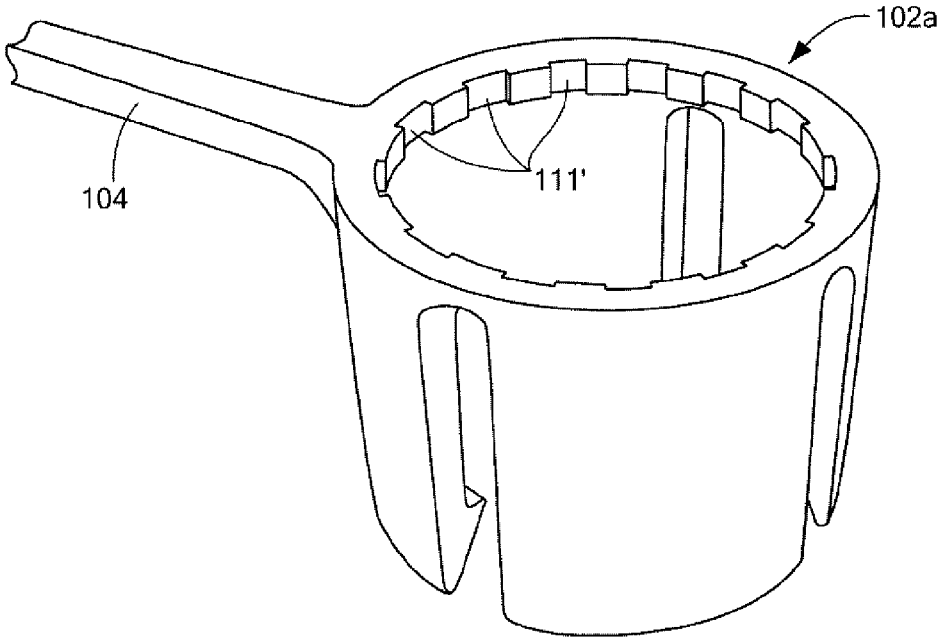

FIGS. 7A and 7B show a version 100' with hard point alignment features which correctly align the hard points in their respective sockets. This example, V-grooves 121 are made in lip 120 of each socket to receive the edges of the hard point. In this example, each finger includes two grooves. In the version shown in FIG. 8A, castellations 121' are used as the alignment features in the lip of each finger (e.g., two castellations per finger). Again, the goal is to align each hard point in its socket as shown in FIG. 4 so the net cords are correctly received in slots 110*a*-110*d*, FIG. 5. For the design shown in FIG. 8B, castellations 111' at the bottom of the socket form the tensile load alignment features for each socket. Stated another way, ridge 111', in this example, is not continuous.

The result is a patching device for a hard point net which is easy and intuitive to use and install, which quickly patches broken net cords, and which correctly spaces the hard points. The patches can be molded of suitable plastic material.

Figure 10:
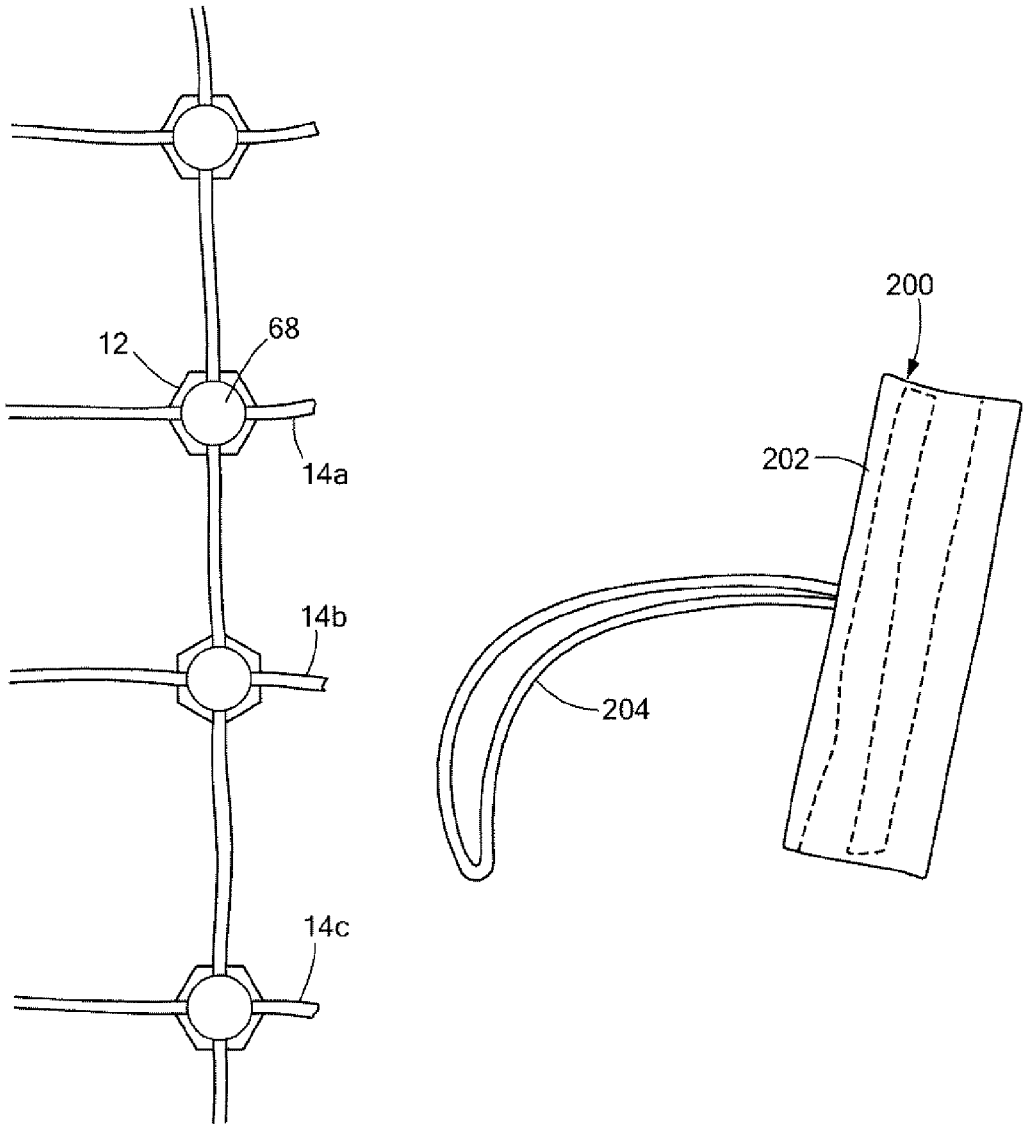
FIG. 10 is a schematic top-view showing an example of another patch device in accordance with the invention.
Figure 11:
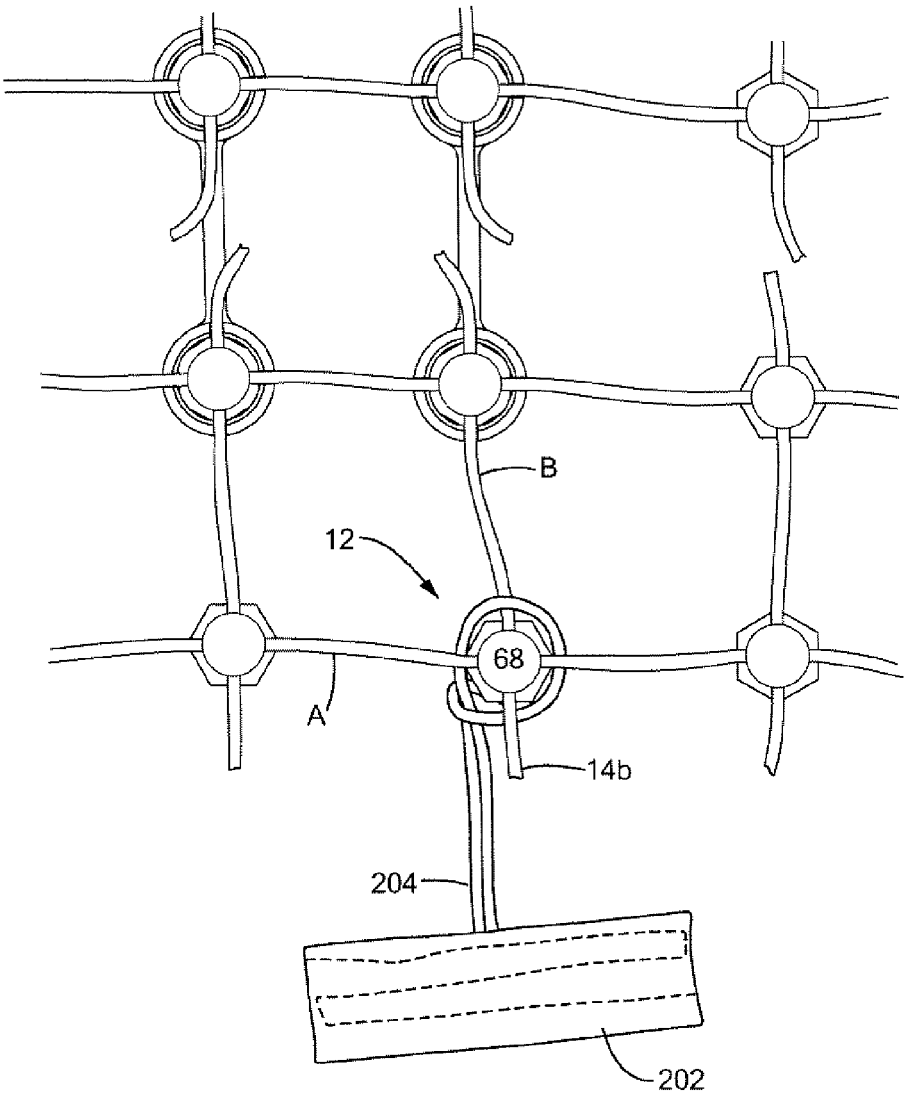
FIG. 11 is a schematic top-view showing the patch device of FIG. 10 now in place about a net hard point.

FIG. 10 depicts another net patching device 200 designed to reconnect hard points to the frame of the net when, for example, net cords 14*a*, 14*b*, and/or 14*c* break as shown at the periphery of the net where the net connects to frame 24, FIG. 1. Flexible Velcro member 202 is securable to a frame member via the Velcro present on the frame member. In one example, one side of member 202 has hooks and the opposite side of member 202 has loops. Both these layers are stitched together as shown capturing flexible loop of string 204 therebetween. In FIG. 11, loop 204 is directed under net cord A, over net cord B, under net cord C (all associated with hard point 12) around hard point 12 as shown and thus is configured to capture the hard point when member 202 is threaded through the loop. Member 202 can now be secured to the net frame using the Velcro and the remainder of the string forms a linkage between the frame and the hard point.

Figure 12:
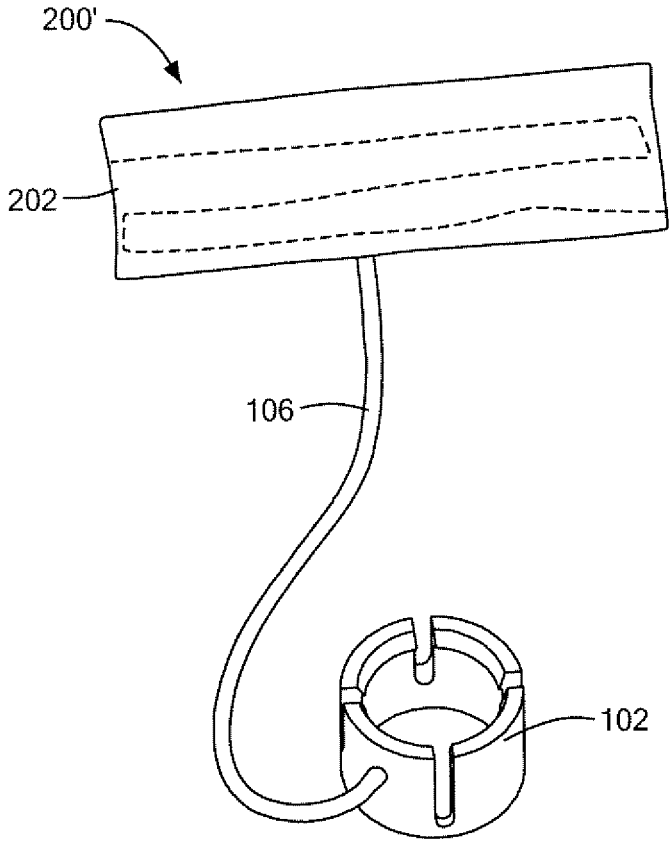
FIG. 12 is a schematic depiction showing another example of a net patching device in accordance with an example of the invention.

In FIG. 12, another design 200' includes flexible Velcro member 202 connected to a socket 102 (as described above) via string 106 or a plastic member. A hard point is placed in socket 102 and then member 202 is attached to the net frame. String or plastic member 106 typically has a length such that the hard point is properly spaced from the frame and its adjacent hard points.

Figure 13:
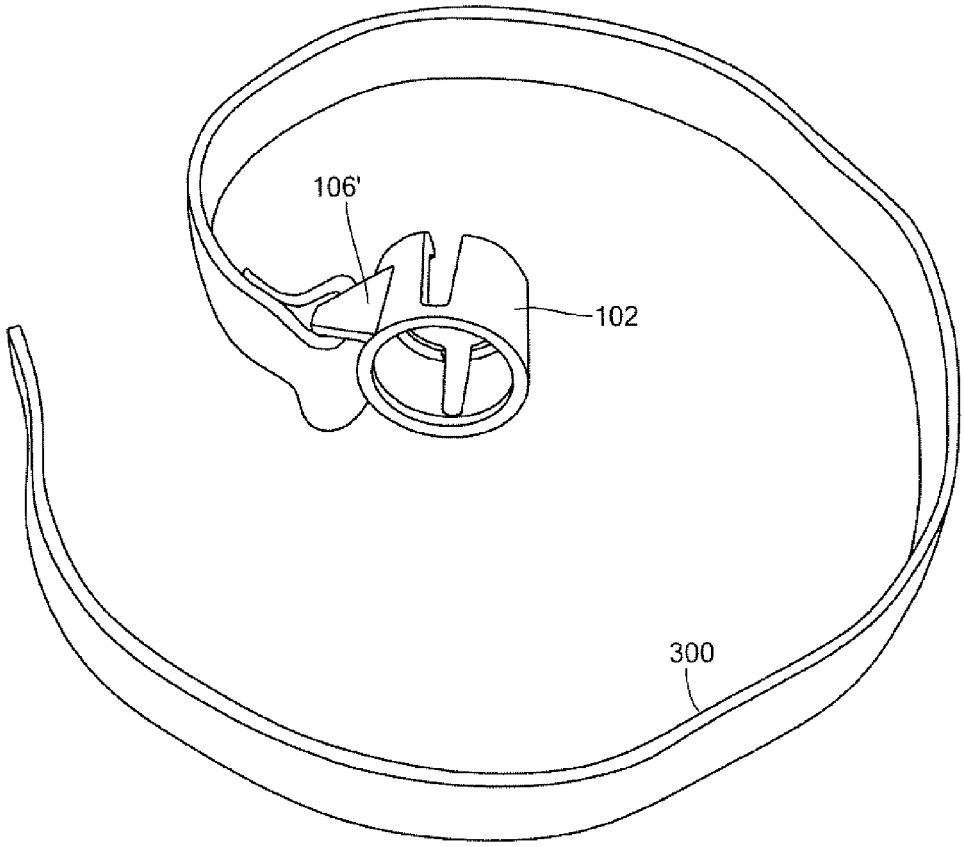
FIG. 13 is a schematic view of another example of a patch device in accordance with the invention.
Figure 14:
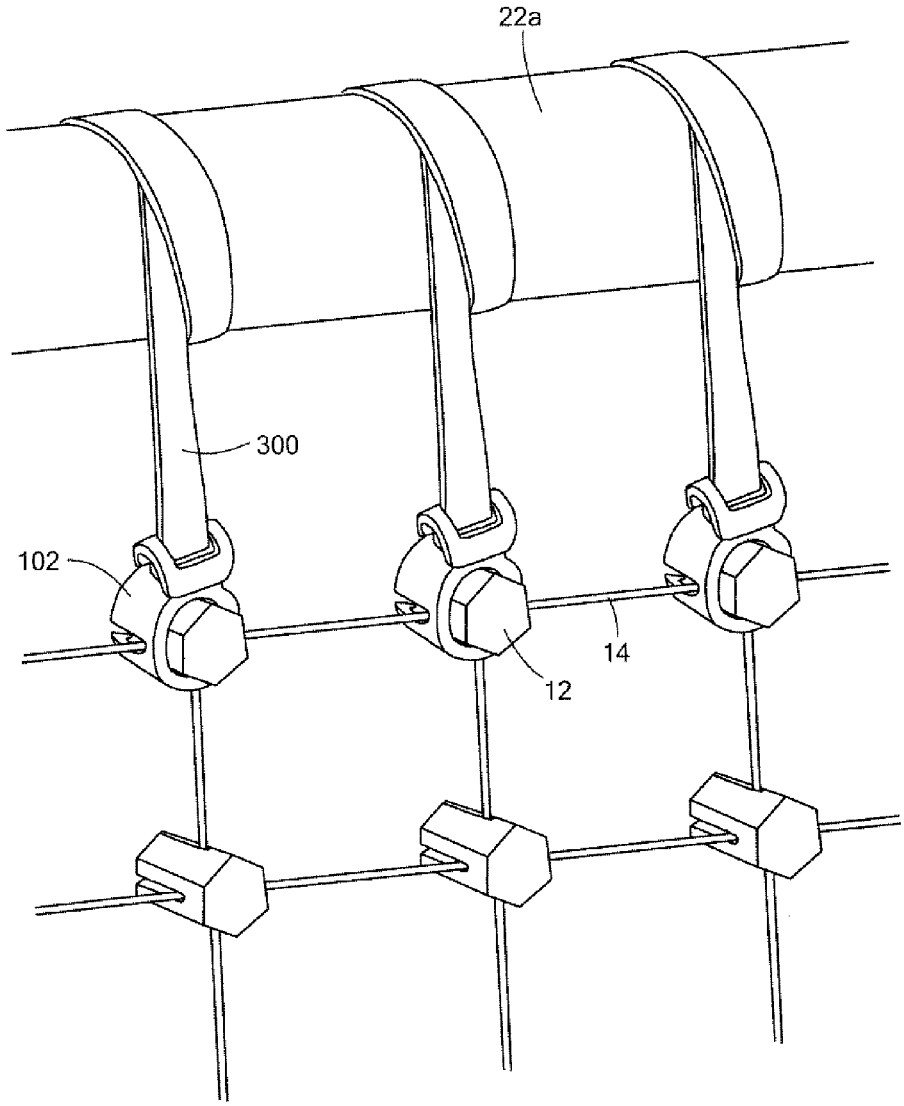
FIG. 14 is a schematic front view showing the patch devices of FIG. 13 in place.
Figure 15A:
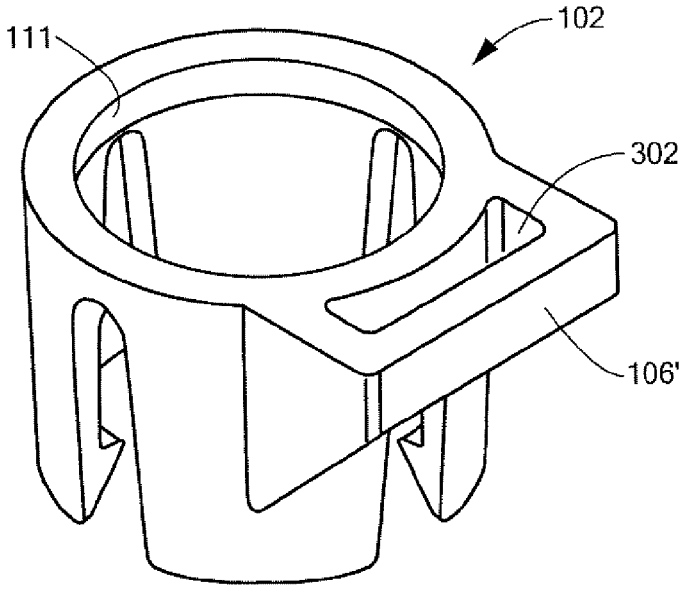
FIGS. 15A-15B are schematic views of the socket portion of the patch devices shown in FIGS. 13-14.
Figure 15B:
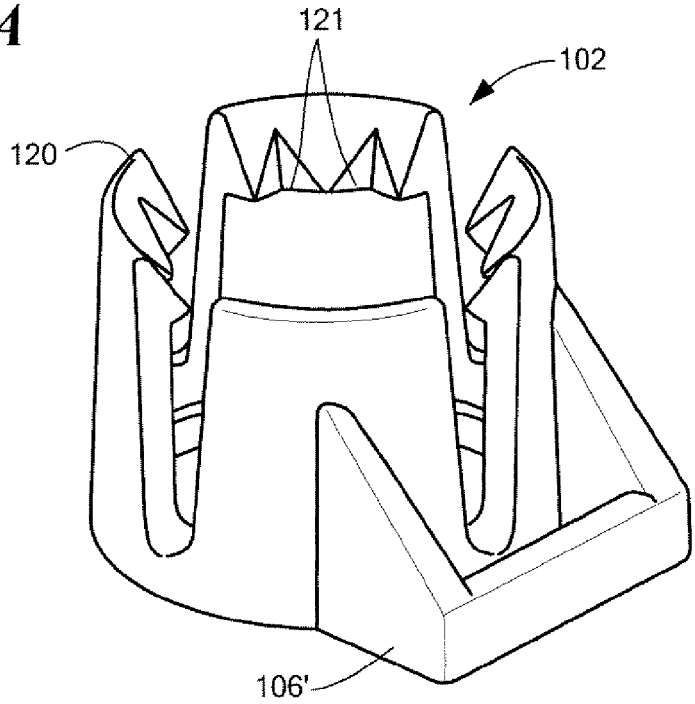

In FIG. 13, Velcro strap 300 is securable about frame member 22*a* in FIG. 14, socket 102 is for a hard point, and linkage 106' allows Velcro strap 300 to be secured to socket 102. FIGS. 15A-15B more clearly show socket 102 which typically includes the features of the socket explained with reference to FIGS. 7A-7B. Strap 300, FIGS. 13-14 is received through linkage slot 302.

A complete net patch system would preferably include several patch members as shown, for example, in FIG. 5 (and/or 7A-7B), and several patching devices as shown in FIGS. 8 and 9 (or 10).

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A patching system for a net on a frame and hard points at select nodes of the net including a patching device comprising:

a pair of spaced sockets each including peripheral side walls defining a cavity and configured to receive a hard point therein, at least one said hard point including a net node therein; and a member interconnecting the pair of spaced sockets configured to properly space the hard points.

2. The system of claim 1 in which each socket includes a retention mechanism for locking a hard point therein.

3. The system of claim 1 in which each socket includes one or more alignment features for aligning a hard point in the socket.

4. The system of claim 1 in which each socket includes one or more tensile alignment features aligning tensile loads with the interconnecting member.

5. The patching system of claim 1 in which each socket includes a peripheral side wall with slots therein for cords of the net.

6. The system of claim 5 in which there are two pairs of opposing slots.

7. The system of claim 5 in which the side wall further includes a retention mechanism.

8. The system of claim 7 in which the retention mechanism includes an inwardly extending lip at a proximal end of the side wall between the slots.

9. The system of claim 8 in which the lip includes one or more alignment features for aligning a hard point in the socket.

10. The system of claim 5 in which each socket includes one or more tensile alignment features aligning tensile loads with the interconnecting member.

11. The system of claim 1 in which the member is a plastic body.

12. The system of claim 1 in which the member is a net cord.

13. The system of claim 1 in which each socket is made of plastic.

14. The system of claim 1 further including a third socket connected to one of the pairs of sockets by another member.

15. The system of claim 1 in which each socket includes flexible fingers which accept a hard point when flexed outward and then spring back capturing the hard point.

16. The system of claim 15 in which each finger includes an inward lip.

17. The system of claim 1 further including at least a second patching device comprising a first member securable to a frame member, a second member configured to lock on to a hard point, and a linkage between the first member and the second member patching a broken net cord between a frame member and a hard point.

18. The system of claim 17 in which the first member is flexible.

19. The system of claim 18 in which the flexible first member is a fabric piece including Velcro thereon.

20. The system of claim 17 in which the second member includes a loop of string.

21. The system of claim 20 in which the loop of string is directed under a first net cord, over a second net cord, under a third net cord, and then the first member is threaded through the loop.

22. The system of claim 17 in which the second member includes a socket configured to receive a hard point therein.

23. The device of claim 22 in which the socket includes one or more alignment features for aligning a hard point in the socket.

24. The device of claim 22 in which the socket includes one or more tensile alignment features aligning tensile loads with the interconnecting member.

25. The system of claim 22 in which the socket includes a retention mechanism for locking a hard point therein.

26. The system of claim 17 in which the linkage includes string.

27. The system of claim 1 further including a second patching device comprising a Velcro strap connected to a socket.

28. A patching system for a net on a frame and with hard points at select nodes of the net including a net frame patching device comprising:

a first member securable to a frame member;

a second member including a peripheral sidewall defining a cavity and configured to lock on to a hard point; and a linkage between the first member and the second member patching a broken net cord between a frame member and a hard point.

29. The patching system of claim 28 further including at least a second patching device configured to properly space hard points including a pair of spaced sockets each configured to receive a hard point therein and a member interconnecting the pair of spaced sockets.

30. The patching system of claim 28 in which the linkage is a string.

31. The patching system of claim 28 in which the linkage is a strap.

32. The patching system of claim 28 in which the linkage is a loop.

33. The patching system of claim 28 in which the first member includes Velcro.

34. The patching system of claim 28 in which the second member is flexible.

35. A patching system for a net on a frame and hard points at select nodes of the net comprising:

a patching device comprising:

a pair of spaced sockets each configured to receive a hard point therein, and a member interconnecting the pair of spaced sockets configured to properly space the hard points; and at least a second patching device comprising:

a first member securable to a frame member, a second member configured to lock on to a hard point, and a linkage between the first member and the second member patching a broken net cord between a frame member and a hard point.

36. A patching system for a net on a frame and hard points at select nodes of the net including a patching device comprising:

a pair of spaced sockets each including a cup-shaped cavity configured to receive a hard point therein; and a member interconnecting the pair of spaced sockets configured to properly space the hard points.

* * * * *